US011155100B2

(12) United States Patent
Odaka

(10) Patent No.: US 11,155,100 B2
(45) Date of Patent: Oct. 26, 2021

(54) THERMAL TRANSFER PRINTING APPARATUS AND THERMAL TRANSFER PRINTING METHOD

(71) Applicant: Dai Nippon Printing Co., Ltd., Tokyo (JP)

(72) Inventor: Tsuaki Odaka, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 42 days.

(21) Appl. No.: 16/623,978

(22) PCT Filed: Jun. 28, 2018

(86) PCT No.: PCT/JP2018/024546
§ 371 (c)(1),
(2) Date: Dec. 18, 2019

(87) PCT Pub. No.: WO2019/004343
PCT Pub. Date: Jan. 3, 2019

(65) Prior Publication Data

US 2020/0139723 A1 May 7, 2020

(30) Foreign Application Priority Data

Jun. 30, 2017 (JP) ..... JP2017-129282

(51) Int. Cl.
*B41J 2/325* (2006.01)
*B41J 2/235* (2006.01)
(Continued)

(52) U.S. Cl.
CPC ..... *B41J 2/325* (2013.01); *B41J 2/235* (2013.01); *B41J 2/36* (2013.01); *B41J 35/16* (2013.01);
(Continued)

(58) Field of Classification Search
CPC ..... B41J 2/325; B41J 2/235; B41J 2/36; B41J 35/16; B41J 2022/30; B41M 5/382
See application file for complete search history.

(56) References Cited

U.S. PATENT DOCUMENTS 5,946,020 A 8/1999 Rogers et al.
6,448,991 B1 9/2002 Doan
2012/0154505 A1* 6/2012 Kaechi ..... B41J 2/325 347/215

FOREIGN PATENT DOCUMENTS

JP S59-140081 A1 8/1984
JP H04-179568 A1 6/1992
(Continued)

OTHER PUBLICATIONS

Extended European Search Report (Application No. 18823757.2) dated Feb. 1, 2021.
(Continued)

*Primary Examiner* — Thinh H Nguyen
(74) *Attorney, Agent, or Firm* — Burr & Brown, PLLC

(57) ABSTRACT

To stabilize image quality of a printed image. A thermal transfer printing apparatus according to the present invention includes a thermal head and a platen roll and forms an image on printing paper by causing the thermal head to heat an ink ribbon including a plurality of consecutive ink layers, each of which includes sequential panels of a yellow layer, a magenta layer, and a cyan layer and thereby transfer ink while transporting, between the thermal head and the platen roll, the ink ribbon and the printing paper that are superimposed on each other. The thermal transfer printing apparatus includes a sensor that detects ink content of the ink layers and a controller that controls energy applied to the thermal head during image formation on a basis of a result of the detection of the sensor.

4 Claims, 6 Drawing Sheets

(51) Int. Cl.

| | |
|---|---|
| ***B41J 2/36*** | (2006.01) |
| ***B41J 35/16*** | (2006.01) |
| ***B41M 5/34*** | (2006.01) |
| ***B41M 5/382*** | (2006.01) |

(52) U.S. Cl.
CPC ..... *B41M 5/34* (2013.01); *B41M 5/382* (2013.01); *B41J 2202/30* (2013.01)

(56) References Cited

FOREIGN PATENT DOCUMENTS

| | | | |
|---|---|---|---|
| JP | H04-332658 | A1 | 11/1992 |
| JP | H07-164655 | A1 | 6/1995 |
| JP | 2000-238308 | A1 | 9/2000 |
| JP | 3118186 | U | 1/2006 |
| JP | 2009-083207 | A1 | 4/2009 |
| JP | 2009-255331 | A1 | 11/2009 |
| JP | 2015-202580 | A1 | 11/2015 |
| JP | 2016-117244 | A1 | 6/2016 |

OTHER PUBLICATIONS

International Search Report and Written Opinion (Application No. PCT/JP2018/024546) dated Sep. 11, 2018.

* cited by examiner

Fig.5
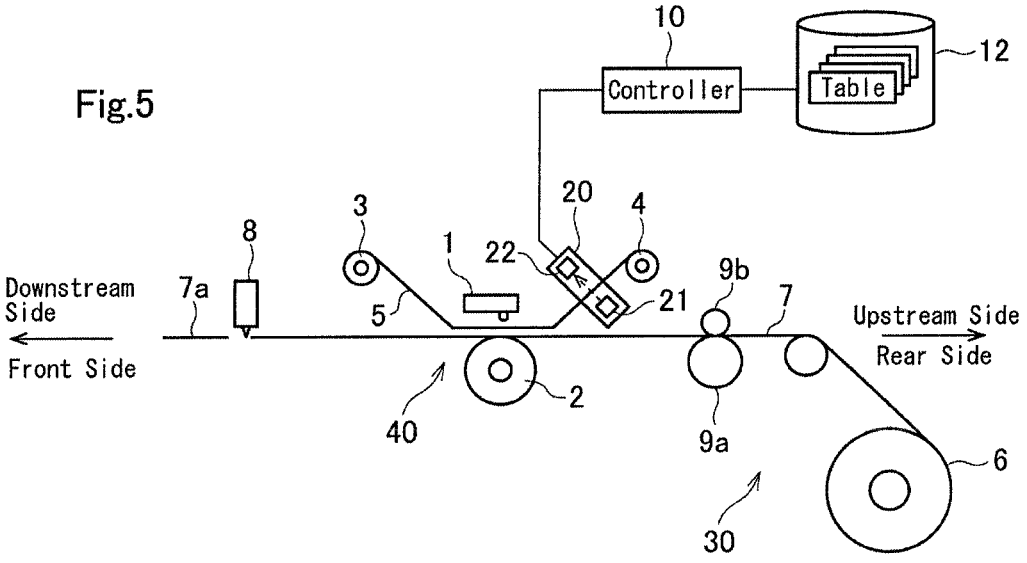
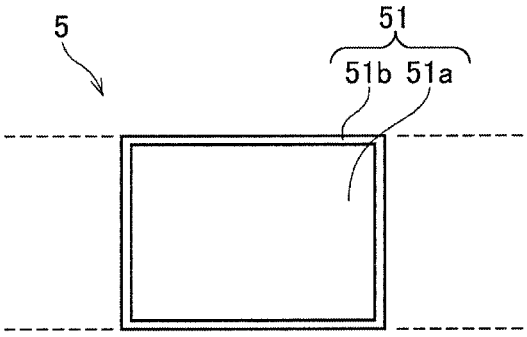
Fig.6

THERMAL TRANSFER PRINTING APPARATUS AND THERMAL TRANSFER PRINTING METHOD

TECHNICAL FIELD

The present invention relates to a thermal transfer printing apparatus and a thermal transfer printing method.

BACKGROUND ART

A known thermal transfer printer transfers ink of an ink ribbon onto printing paper in a pattern corresponding to an image by applying heat from a thermal head to the ink ribbon while holding the ink ribbon and the printing paper between the thermal head and a platen roll.

The ink ribbon has a plurality of consecutive dye layers, each of which includes sequential panels of a yellow layer, a magenta layer, and a cyan layer. The ink ribbon is fed out from an ink ribbon feeding roll around which the ink ribbon is wound, passes the thermal head, and is collected by an ink ribbon collecting roll.

Ink content (an ink application amount) slightly varies from one ink ribbon to another depending on a manufacturing plant and a manufacturing time. Even in a case where the same printing energy is applied by a thermal head, a density and the like of an image formed on printing paper differ between a case where an ink ribbon containing a large amount of ink is used and a case where an ink ribbon containing a small amount of ink is used. This results in variations in image quality.

Furthermore, even in a case where ink ribbons containing similar amounts of ink are used, a density and the like of an image formed on printing paper differ due to a difference in a surrounding environment (a temperature, a humidity) before the ink ribbon is mounted in a thermal transfer printer and a difference in an environment in which the thermal transfer printer is placed. This results in variations in image quality.

CITATION LIST

Patent Literature

PTL 1: Japanese Unexamined Patent Application Publication No. 2009-83207

SUMMARY OF INVENTION

The present invention was accomplished in view of the above conventional circumstances, and an object of the present invention is to provide a thermal transfer printing apparatus and a thermal transfer printing method that can stabilize image quality of a printed image.

According to the present invention, a thermal transfer printing apparatus includes a thermal head and a platen roll, and forms an image on printing paper by causing the thermal head to heat an ink ribbon including a plurality of consecutive ink layers, each of which includes sequential panels of a yellow layer, a magenta layer, and a cyan layer and thereby transfer ink while transporting, between the thermal head and the platen roll, the ink ribbon and the printing paper that are superimposed on each other. The thermal transfer printing includes a sensor detecting ink content of the ink layers, and a controller controlling energy applied to the thermal head during image formation based on a result of the detection of the sensor.

According to one aspect of the present invention, the sensor includes a light emitting unit irradiating the ink ribbon with light and a light receiving unit receiving light that has passed through the ink ribbon.

According to one aspect of the present invention, the sensor is provided between an ink ribbon feeding unit that feeds the ink ribbon and the thermal head.

According to one aspect of the present invention, the sensor is provided between the thermal head and an ink ribbon collecting unit collecting a used ink ribbon.

According to one aspect of the present invention, the sensor detects ink content in a printed region used for formation of an image on the printing paper and ink content in a non-printed region that is not used for image formation.

According to one aspect of the present invention, the ink ribbon includes sequential panels of a yellow layer, a magenta layer, a cyan layer, and a protection layer, the thermal head transfers the protection layer onto an image formed on the printing paper, and the sensor includes a light emitting unit irradiating the ink ribbon with light and a light receiving unit receiving light that has passed through the ink ribbon, and measures an intensity of light that has passed through the printed region of the yellow layer, the magenta layer, or the cyan layer, an intensity of light that has passed through the non-printed region of the yellow layer, the magenta layer, or the cyan layer, and an intensity of light that has passed through a protection layer formation region.

According to the present invention, a thermal transfer printing method includes feeding out printing paper from a printing paper roll, forming an image by causing a thermal head to transfer yellow, magenta, and cyan onto the printing paper by using an ink layer included in an ink ribbon including a plurality of consecutive ink layers, each of which includes sequential panels of a yellow layer, a magenta layer, and a cyan layer, detecting ink content of the ink layer, and controlling energy applied to the thermal head during image formation based on the detected ink content.

According to one aspect of the present invention, the ink content of the ink layer is detected before image formation.

According to one aspect of the present invention, ink content in a printed region of the ink layer that is used for image formation on the printing paper and ink content in a non-printed region of the ink layer that is not used for image formation are detected after the image formation.

Advantageous Effects of Invention

According to the present invention, image quality of a printed image can be stabilized irrespective of ink content of an ink ribbon and a surrounding environment.

BRIEF DESCRIPTION OF DRAWINGS

FIG. 5 schematically illustrates a configuration of a thermal transfer printing apparatus according to a third embodiment.

FIG. 6 is a plan view illustrating an example of a printed region and a non-printed region of an ink ribbon.

DESCRIPTION OF EMBODIMENTS

Embodiments of the present invention are described below with reference to the drawings.

First Embodiment

Figure 1:
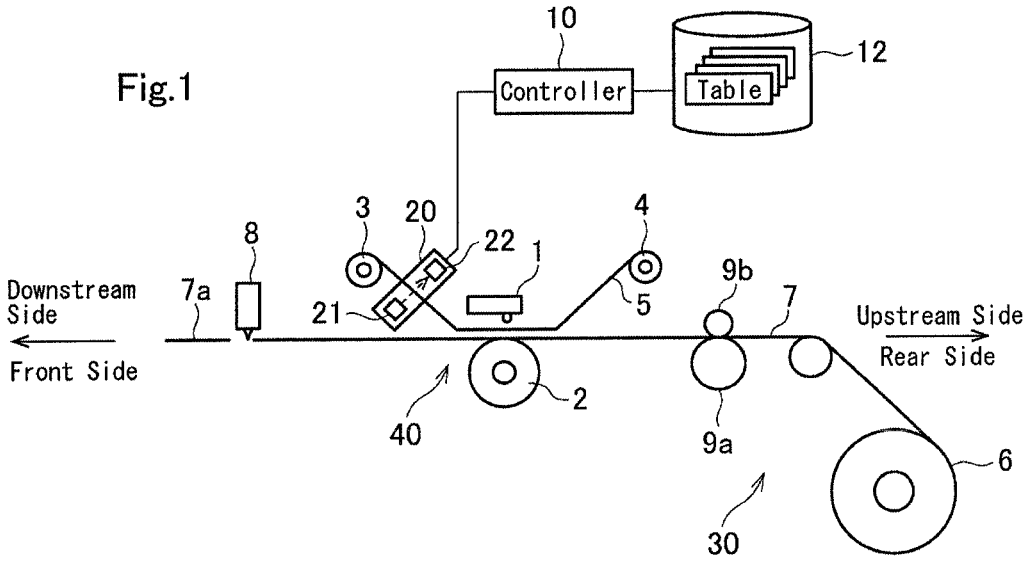
FIG. 1 schematically illustrates a configuration of a thermal transfer printing apparatus according to a first embodiment of the present invention.
Figure 2:
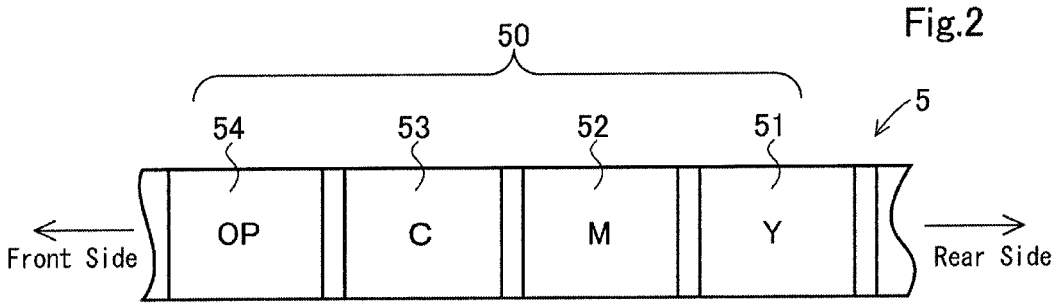
FIG. 2 is a plan view of an ink ribbon.

FIG. 1 schematically illustrates a configuration of a thermal transfer printing apparatus according to a first embodiment of the present invention, and FIG. 2 is a plan view of an ink ribbon used in the thermal transfer printing apparatus. The thermal transfer printing apparatus prints an image by sublimation transfer of yellow, magenta, and cyan on a printing sheet (printing paper, receiver paper).

An ink ribbon 5 has sequential panels of an Y layer 51 containing yellow dye, an M layer 52 containing magenta dye, a C layer 53 containing cyan dye, and a protection (OP) layer 54. The ink ribbon 5 may further has a black (Bk) molten layer. The thermal transfer printing apparatus includes a thermal head 1 that prints an image by sublimation transfer of Y, M, and C on a printing sheet 7 (printing paper) by using the ink ribbon 5 and forms a protection layer on the image.

An ink ribbon feeding unit 3 around which the ink ribbon 5 is wound is provided on a downstream side of the thermal head 1, and an ink ribbon collecting unit 4 is provided on an upstream side of the thermal head 1. The ink ribbon 5 fed out from the ink ribbon feeding unit 3 passes the thermal head 1 and is collected by the ink ribbon collecting unit 4.

A platen roll 2 that is rotatable is provided below the thermal head 1. A printing unit 40 that includes the thermal head 1 and the platen roll 2 forms an image by heating the ink ribbon 5 and thereby thermally transferring ink onto the printing sheet 7 while holding the printing sheet 7 and the ink ribbon 5.

Furthermore, the printing unit 40 laminates a protection layer on an image by heating the OP layer 54. In a case where laminate energy applied during protection layer formation (printing energy of the printing unit 40) is high, a surface of the protection layer becomes matt (less shiny), whereas in a case where the laminate energy is low, the surface of the protection layer becomes glossy (shiny).

A capstan roller 9*a* that is used to transfer the printing sheet 7 and is driven to be rotatable and a pinch roller 9*b* for pressing the printing sheet 7 against the capstan roller 9*a* are provided on an upstream side of the thermal head 1.

The ink ribbon 5 is configured such that an Y layer 51, an M layer 52, a C layer 53, and an OP layer 54 are sequentially provided on one surface of a base material layer from the ink ribbon collecting unit 4 side. In other words, a plurality of consecutive ink layers 50 (each of which is for a single frame), each of which includes the Y layer 51, the M layer 52, the C layer 53, and the OP layer 54, are provided. The Y layer 51, the M layer 52, and the C layer 53 each have a size slightly larger than an image of a single frame formed on the printing sheet 7.

The Y layer 51, the M layer 52, and the C layer 53 each are preferably made of a material obtained by melting or dispersing sublimation dye in a binder resin. The OP layer 54 is preferably made of a transparent material having properties such as adhesiveness and light resistance.

The base material layer is a layer for supporting the ink layers 50 and can be a conventionally known layer having a certain degree of heat resistance and strength. Examples of the base material layer include a polyethylene terephthalate film, a polyethylene naphthalate film, a polystyrene film, a polypropylene film, and a polycarbonate film.

A back-surface layer is provided on the other surface of the base material layer, i.e., a surface opposite to a surface on which the ink layers 50 are provided. The thermal head 1 heats the ink ribbon 5 from a back-surface layer side. The back-surface layer has a function of improving heat resistance so that the ink ribbon 5 is not deformed by heat during heat transfer and suppressing sticking and the like by improving travelling performance of the thermal head 1 during heat transfer. The back-surface layer is generally formed by applying and drying a binder resin to which a lubricant, a surfactant, inorganic particles, organic particles, a pigment, and the like have been added.

The printing sheet 7 is wound around a printing paper roll 6 and is fed out from the printing paper roll 6. A known printing sheet can be used as the printing sheet 7. The printing sheet 7 is fed out (transported to a front side) and is rewound (transported to a rear side) by a driving unit 30 including the printing paper roll 6, the capstan roller 9*a*, and the pinch roller 9*b*.

The printing sheet 7 on which an image has been formed and a protection layer has been laminated by the printing unit 40 is cut out as a print piece 7*a* by a cutter 8 on the downstream side. The print piece 7*a* is discharged from an outlet (not illustrated).

A sensor 20 that detects ink content of the Y layer 51, the M layer 52, and the C layer 53 of the ink ribbon 5 fed out from the ink ribbon feeding unit 3 is provided between the thermal head 1 and the ink ribbon feeding unit 3. For example, the sensor 20 has a light emitting unit 21 that irradiates the ink ribbon 5 (the Y layer 51, the M layer 52, and the C layer 53) with light and a light receiving unit 22 that receives transmission light that has passed through the ink ribbon 5. An intensity of light received by the light receiving unit 22 becomes weaker as ink content of the ink ribbon 5 becomes larger. Meanwhile, an intensity of light received by the light receiving unit 22 becomes stronger as the ink content of the ink ribbon 5 becomes smaller.

A plurality of light emitting units 21 that emit light of wavelengths suitable for the respective colors of the Y layer 51, the M layer 52, and the C layer 53 may be provided.

A storage unit 12 is, for example, a hard disk device or a flash memory and stores therein a table that defines energy to be applied by the thermal head 1 to print an image of a desired density. This table is prepared for each ink content of the ink ribbon 5 for each set of Y, M, and C.

A controller 10 performs image formation processing by controlling driving of each unit of the thermal transfer printing apparatus. Furthermore, the controller 10 acquires a light receiving intensity from the light receiving unit 22 and extracts a table corresponding to this light receiving intensity (ink content of the ink ribbon 5) from the storage unit 12. The controller 10 controls energy to be applied by the thermal head 1 during image formation with reference to the extracted table.

Figure 3:
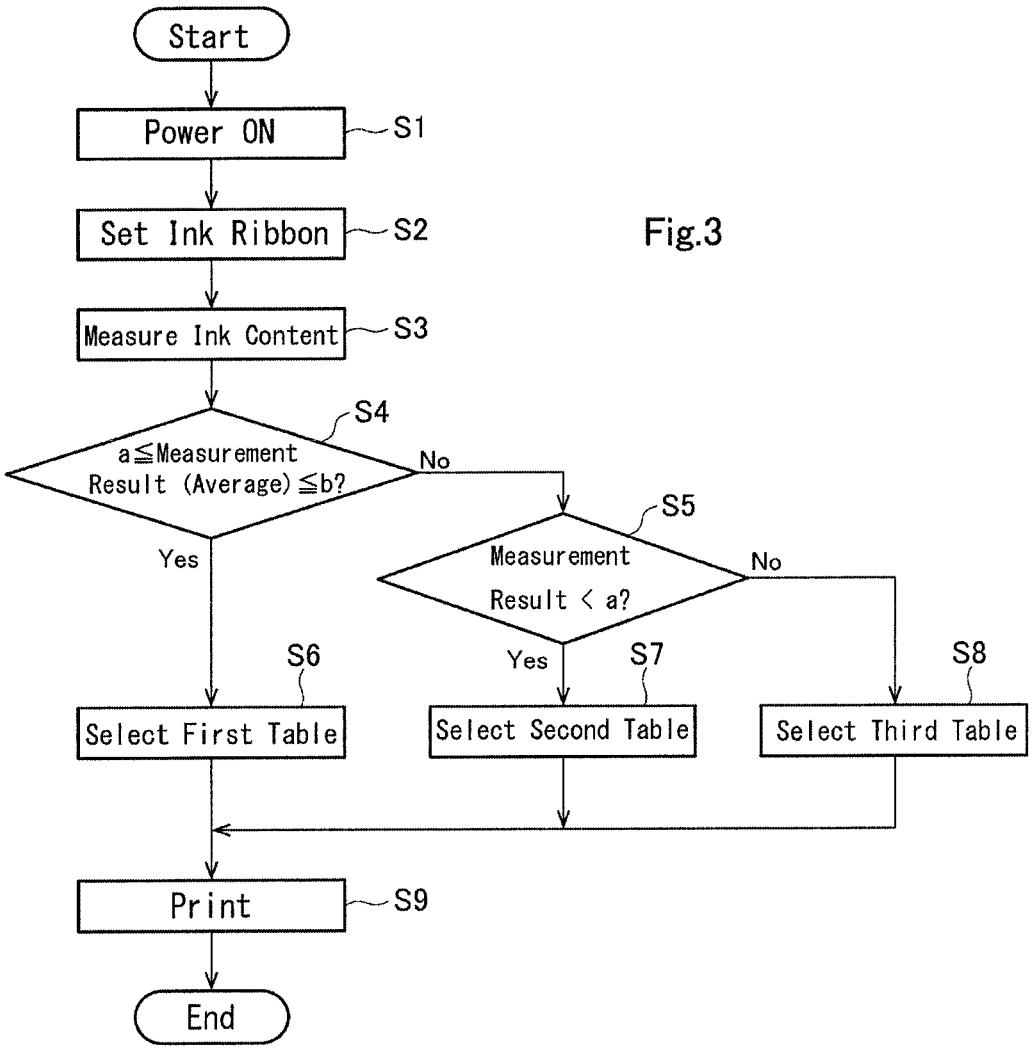
FIG. 3 is a flowchart for explaining a thermal transfer printing method according to the first embodiment.

A thermal transfer printing method according to the present embodiment is described by using the flowchart of FIG. 3. When the thermal transfer printing apparatus is powered on (step S1) and a new ink ribbon 5 is set (step S2), the thermal transfer printing apparatus performs initial operation. In this initial operation, the ink ribbon 5 is wound up or rewound.

In this state, the sensor 20 measures ink content by irradiating the Y layer 51, the M layer 52, and the C layer 53 of an initial ink layer 50 with light (step S3).

For example, the controller 10 calculates an average of light receiving intensities of transmission light that has passed through the Y layer 51, the M layer 52, and the C layer 53. In a case of a result of the calculation is equal to or larger than a first predetermined value a and is equal to or smaller than a second predetermined value b (Yes in step S4), the controller 10 selects a first table from the storage unit 12 (step S6).

In a case where the result of the calculation is less than the first predetermined value a (No in step S4 and Yes in step S5), the controller 10 selects a second table from the storage unit 12 (step S7).

In a case where the result of the calculation is larger than the second predetermined value b (No in step S4 and No in step S5), the controller 10 selects a third table from the storage unit 12 (step S8).

After the table selection, printing processing is performed (step S9). In the printing processing, first, the printing sheet 7 and the Y layer 51 are positioned so as to overlap each other, and the thermal head 1 makes contact with the platen roll 2 with the printing sheet 7 and the ink ribbon 5 interposed therebetween. Next, the capstan roller 9*a* and the ink ribbon collecting unit 4 are driven to rotate so that the printing sheet 7 and the ink ribbon 5 are delivered to a rear side. During this period, a region of the Y layer 51 is selectively heated sequentially by the thermal head 1 on the basis of image data, and thereby Y is sublimation-transferred from the ink ribbon 5 onto the printing sheet 7.

After the sublimation transfer of Y, the thermal head 1 rises away from the platen roll 2. Next, the printing sheet 7 and the M layer 52 are positioned so as to overlap each other. In this case, the printing sheet 7 is fed to the front side by a distance corresponding to a print size, and the ink ribbon 5 is fed to the rear side by a distance corresponding to a margin between the Y layer 51 and the M layer 52.

M and C are sequentially sublimation-transferred onto the printing sheet 7 on the basis of the image data in a manner similar to the sublimation transfer of Y, and thus an image is formed on the printing sheet 7. The controller 10 controls energy applied by the thermal head 1 during transfer of Y, M, and C with reference to the table selected in any one of steps S6 to S8. The printing processing is performed with reference to the same table until the thermal transfer printing apparatus is powered off.

After the image formation, the OP layer 54 is transferred onto the whole image by the thermal head 1, and thus a protection layer is formed. Then, the printing sheet 7 is cut out as a print piece 7*a* by the cutter 8 on a downstream side.

As described above, in the present embodiment, ink content of the ink ribbon 5 loaded into the thermal transfer printing apparatus is measured, and an image is printed by sublimation-transferring the Y layer 51, the M layer 52, and the C layer 53 with applied energy corresponding to a result of the measurement. It is therefore possible to stabilize image quality of a printed image irrespective of the ink content of the ink ribbon 5.

Although an example in which a table in the storage unit 12 is selected on the basis of an average of light receiving intensities of transmission light that has passed through the Y layer 51, the M layer 52, and the C layer 53 has been described in the above embodiment, tables of the respective colors may be individually selected on the basis of light receiving intensities of transmission light that has passed through the Y layer 51, the M layer 52, and the C layer 53 in a case where tables of the respective colors are prepared for each light receiving intensity.

Alternatively, a light receiving intensity of transmission light that has passed through any one or two of the Y layer 51, the M layer 52, and the C layer 53 may be measured, and a table for an YMC set may be selected on the basis of a result of the measurement.

Although measurement of ink content and selection of a table are performed when a new ink ribbon 5 is set after power activation in the above embodiment, measurement of ink content and selection of a table may be performed at constant time intervals. For example, measurement of ink content and selection of a table may be performed at a predetermined time one time in one day.

Second Embodiment

Figure 4:
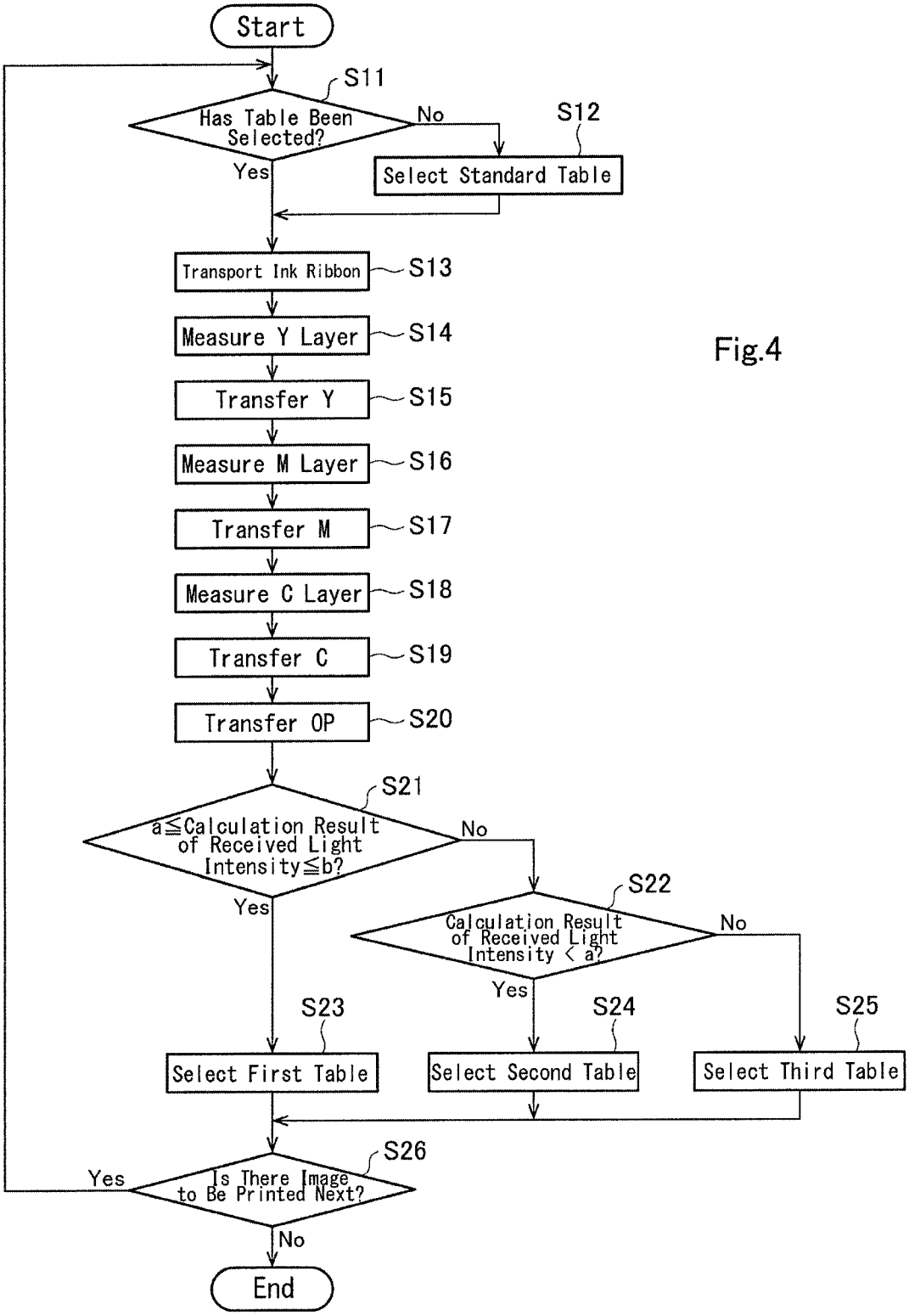
FIG. 4 is a flowchart for explaining a thermal transfer printing method according to a second embodiment.

Although a table is selected on the basis of a result of measurement of ink content of an initial (leading) ink layer 50 of an ink ribbon 5 including a plurality of ink layers 50 and the same table is applied to subsequent ink layers 50 in the first embodiment, a table may be selected on the basis of a result of measurement of ink contents of the respective ink layers 50, and the selected table may be applied to printing processing using a next ink layer 50. Such a thermal transfer printing method is described with reference to the flowchart illustrated in FIG. 4.

In a case where a table has been already selected (Yes in step S11), the processing proceeds to step S13. In a case where a table has not been selected yet (No in step S11), i.e., in a case where an initial ink layer 50 is used, a standard table that defines a printed image density and standard printing energy is selected (step S12).

Transport of the ink ribbon 5 starts, and the ink ribbon feeding unit 3 feeds out the ink ribbon 5, and the ink ribbon collecting unit 4 rewinds the ink ribbon 5 (step S13).

The sensor 20 measures a light receiving intensity by irradiating an Y layer 51 with light before a printing sheet 7 and the Y layer 51 are held between a thermal head 1 and a platen roll 2 (step S14). The thermal head 1 heats the Y layer 51 by controlling applied energy on the basis of the selected table and thus sublimation-transfers Y from the ink ribbon 5 onto the printing sheet 7 (step S15).

The sensor 20 measures a light receiving intensity by irradiating an M layer 52 with light before the printing sheet 7 and the M layer 52 are held between the thermal head 1 and the platen roll 2 (step S16). The thermal head 1 heats the M layer 52 by controlling applied energy on the basis of the selected table and thus sublimation-transfers M from the ink ribbon 5 onto the printing sheet 7 (step S17).

The sensor 20 measures a light receiving intensity by irradiating a C layer 53 with light before the printing sheet 7 and C layer 53 are held between the thermal head 1 and the platen roll 2 (step S18). The thermal head 1 heats the C layer 53 by controlling applied energy on the basis of the selected table and thus sublimation-transfers C from the ink ribbon 5 onto the printing sheet 7 (step S19).

The OP layer 54 is transferred onto the image formed on the printing sheet 7 (step S20). Then, the printing sheet 7 is cut out as a print piece 7*a* by a cutter 8 on the downstream side.

A controller 10 calculates an average of light receiving intensities of transmission light that has passed through the Y layer 51, the M layer 52, and the C layer 53 measured in steps S14, S16, and S18. In a case where a result of the calculation is equal to or larger than a first predetermined value a and is equal to or smaller than a second predetermined value b (Yes in step S21), the controller 10 selects a first table from a storage unit 12 (step S23).

In a case where the result of the calculation is less than the first predetermined value a (No in step S21 and Yes in step S22), the controller 10 selects a second table from the storage unit 12 (step S24).

In a case where the result of the calculation is larger than the second predetermined value b (No in step S21 and No in step S22), the controller 10 selects a third table from the storage unit 12 (step S25).

In a case where there is an image to be printed next (Yes in step S26), printing processing is performed by controlling applied energy on the basis of the table selected in any one of steps S23 to S25.

As described above, even in a case where a table is selected on the basis of a result of measurement of ink content of a previous ink layer 50 and applied energy during printing processing is controlled on the basis of the selected table, image quality of a printed image can be stabilized irrespective of the ink content of the ink ribbon 5.

Also in the present embodiment, tables of the respective colors may be individually selected on the basis of light receiving intensities of transmission light that has passed through the Y layer 51, the M layer 52, and the C layer 53. Furthermore, a light receiving intensity of transmission light that has passed through any one or two of the Y layer 51, the M layer 52, and the C layer 53 may be measured, and a table for an YMC set may be selected on the basis of a result of the measurement.

Although a table is selected on the basis of a result of measurement of ink content of a previous ink layer 50 and applied energy during printing processing is controlled on the basis of the table in the present embodiment, a table selected on the basis of a result of measurement of ink content of an ink layer 50 may be immediately applied to printing processing using the same ink layer 50.

Third Embodiment

FIG. 5 schematically illustrates a configuration of a thermal transfer printing apparatus according to a third embodiment. The present embodiment is different from the first embodiment illustrated in FIG. 1 in that a sensor 20 is provided between a thermal head 1 and an ink ribbon collecting unit 4. Description of elements similar to those of the first embodiment is omitted.

In the present embodiment, the sensor 20 detects ink contents of an Y layer 51, an M layer 52, and a C layer 53 of a used ink ribbon 5 wound up by the ink ribbon collecting unit 4 after printing processing in a printing unit 40.

As described above, the Y layer 51, the M layer 52, and the C layer 53 each have a size slightly larger than a size of an image of a single frame formed on printing sheet 7. Accordingly, a peripheral region of each of the Y layer 51, the M layer 52, and the C layer 53 after the printing processing is a non-printed region that is not used for printing, and ink remains without being used in the non-printed region. Meanwhile, on a printed region on an inner side of the non-printed region, ink of an amount corresponding to a printing density remains since ink shifts to the printing sheet 7 side when an image is printed. For example, as illustrated in FIG. 6, the Y layer 51 after the printing processing is made up of a printed region 51*a* and a non-printed region 51*b* having a frame shape.

The sensor 20 measures ink content (remaining amounts) by irradiating the printed region and the non-printed region with light. A difference between an intensity of light received when the non-printed region is irradiated with light and an intensity of light received when the printed region is irradiated with light corresponds to an amount of ink (an ink transfer amount) actually transferred onto the printing sheet 7.

The amount of ink transferred onto the printing sheet 7 varies depending on an environment in which the ink ribbon 5 is stored before being mounted in the thermal transfer printing apparatus and an environment (a temperature, a humidity) in which the thermal transfer printing apparatus is placed. This can result in variations in image quality. In the present embodiment, an ink transfer amount is found on the basis of a difference between an amount of ink remaining on a printed region and an amount of ink remaining on a non-printed region, and a table is selected so that ink is transferred in a desired amount, i.e., an image of desired image quality can be printed.

A storage unit 12 stores therein difference predicted value information in which energy during image printing and a difference in light receiving intensity predicted in a case where printing is performed with this energy are associated with each other. The difference predicted value information is prepared for each of Y, M, and C. The difference predicted value information may be prepared for each intensity of light received in a case where the non-printed region is irradiated with light. A controller 10 compares a difference between measured light receiving intensities (an actual measurement value of the difference) and a difference between light receiving intensities (a predicted value of the difference) based on the difference predicted value information and selects a table on the basis of a result of the comparison.

Figure 7:
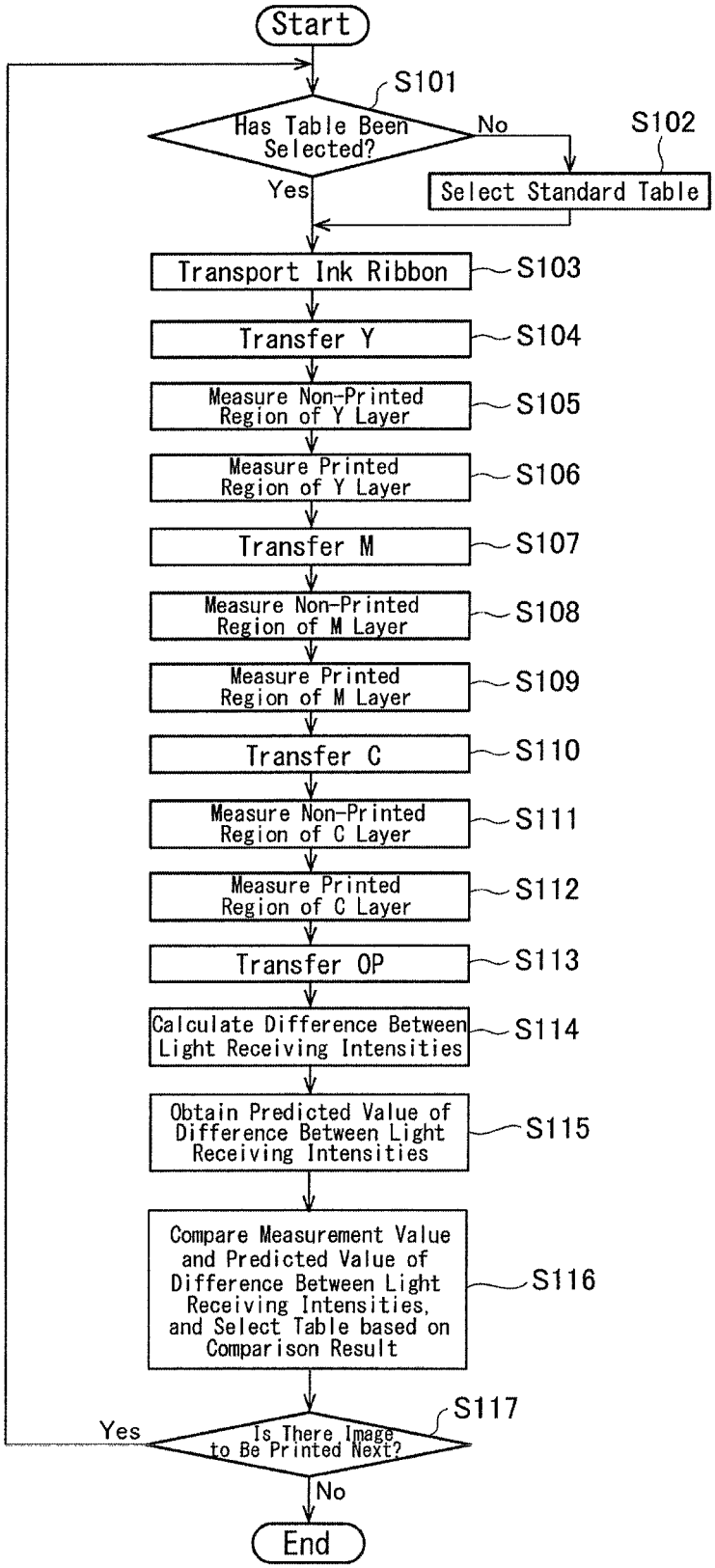
FIG. 7 is a flowchart for explaining a thermal transfer printing method according to the third embodiment.

A thermal transfer printing method according to the present embodiment is described by using the flowchart of FIG. 7.

In a case where a table has been already selected (Yes in step S101), the processing proceeds to step S103. In a case where a table has not been selected yet (No in step S101), i.e., in a case where an initial ink layer 50 is used, a standard table that defines a printed image density and standard applied energy is selected (step S102).

Transport of the ink ribbon 5, and an ink ribbon feeding unit 3 feeds out the ink ribbon 5, and the ink ribbon collecting unit 4 rewinds the ink ribbon 5 (step S103).

The thermal head 1 heats the Y layer 51 by controlling applied energy on the basis of the selected table and thus sublimation-transfers Y from the ink ribbon 5 onto the printing sheet 7 (step S104).

The sensor 20 measures a light receiving intensity by irradiating a non-printed region of the Y layer 51 after the printing processing with light (step S105). Furthermore, the sensor 20 measures a light receiving intensity by irradiating a printed region of the Y layer 51 after the printing processing with light (step S106). An average of light receiving intensities may be found by irradiating a plurality of parts within the printed region with light or the entire surface of the printed region may be irradiated with light. Alternatively, a part to which predetermined energy was applied during the printing processing may be irradiated with light.

The thermal head 1 heats the M layer 52 by controlling applied energy on the basis of the selected table and thus sublimation-transfers M from the ink ribbon 5 onto the printing sheet 7 (step S107).

The sensor 20 measures a light receiving intensity by irradiating a non-printed region of the M layer 52 after the printing processing with light (step S108). Furthermore, the sensor 20 measures a light receiving intensity by irradiating a printed region of the M layer 52 after the printing processing with light (step S109).

The thermal head 1 heats the C layer 53 by controlling applied energy on the basis of the selected table and thus sublimation-transfers C from the ink ribbon 5 onto the printing sheet 7 (step S110).

The sensor 20 measures a light receiving intensity by irradiating a non-printed region of the C layer 53 after the printing processing with light (step S111). Furthermore, the sensor 20 measures a light receiving intensity by irradiating a printed region of the C layer 53 after the printing processing with light (step S112).

The OP layer 54 is transferred onto the image formed on the printing sheet 7 (step S113). Then, the printing sheet 7 is cut out as a print piece 7*a* by a cutter 8 on a downstream side.

The controller 10 calculates a difference between the light receiving intensities measured in steps S105 and S106 (step S114). This difference corresponds to an ink transfer amount of Y. Similarly, the controller 10 calculates a difference between the light receiving intensities measured in steps S108 and S109. This difference corresponds to an ink transfer amount of M. Furthermore, the controller 10 calculates a difference between the light receiving intensities measured in steps S111 and S112. This difference corresponds to an ink transfer amount of C.

The controller 10 obtains, for each of Y, M, and C, a predicted value of a difference between light receiving intensities on the basis of the difference predicted value information stored in the storage unit 12 and image data used for the printing processing (step S115).

The controller 10 compares, for each of Y, M, and C, the actual measurement value of the difference between the light receiving intensities calculated in step S114 and the predicted value of the difference between the light receiving intensities found in step S115 and selects a table on the basis of a result of the comparison (e.g., a degree of deviation between the actual measurement value and the predicted value) (step S116).

In a case where there is an image to be printed next (Yes in step S117), printing processing is performed by controlling applied energy on the basis of the table selected in step S116.

As described above, in a case where a table is selected on the basis of a result of measurement of an ink transfer amount of a previous ink layer 50 and applied energy during printing processing is controlled on the basis of the selected table, image quality of an image to be printed can be stabilized irrespective of an environment in which the ink ribbon 5 is stored and an environment in which the thermal transfer printing apparatus is placed.

Also in the present embodiment, a light receiving intensity difference of any one or two of the Y layer 51, the M layer 52, and the C layer 53 may be measured, and a table set may be selected on the basis of a result of the measurement.

Fourth Embodiment

Although a light receiving intensity difference between a printed region and a non-printed region of each of a Y layer 51, an M layer 52, and a C layer 53 after printing processing is found in the third embodiment, a table may be selected on the basis of a light receiving intensity ratio.

As described above, an ink ribbon 5 has a back-surface layer. When light emitted from a light emitting unit 21 of a sensor 20 passes through the ink ribbon 5, the light attenuates due to the back-surface layer. In a case where a light receiving intensity difference between a printed region and a non-printed region is found, a component of attenuation caused by the back-surface layer is cancelled. Meanwhile, in a case where a light receiving intensity ratio is found, a more accurately value can be obtained since influence of attenuation caused by the back-surface layer is taken into consideration.

In view of this, in the present embodiment, a transparent OP layer 54 is also irradiated with light, and an amount x of light attenuation caused by the back-surface layer is calculated on the basis of a light receiving intensity thus obtained. Then, a ratio $(y-x)/(z-x)$ of a value obtained by subtracting the light attenuation amount x from an intensity y of light received in a case where the non-printed region is irradiated with light to a value obtained by subtracting the light attenuation amount x from an intensity z of light received in a case where the printed region is irradiated with light is calculated as a light receiving intensity ratio.

Figure 8:
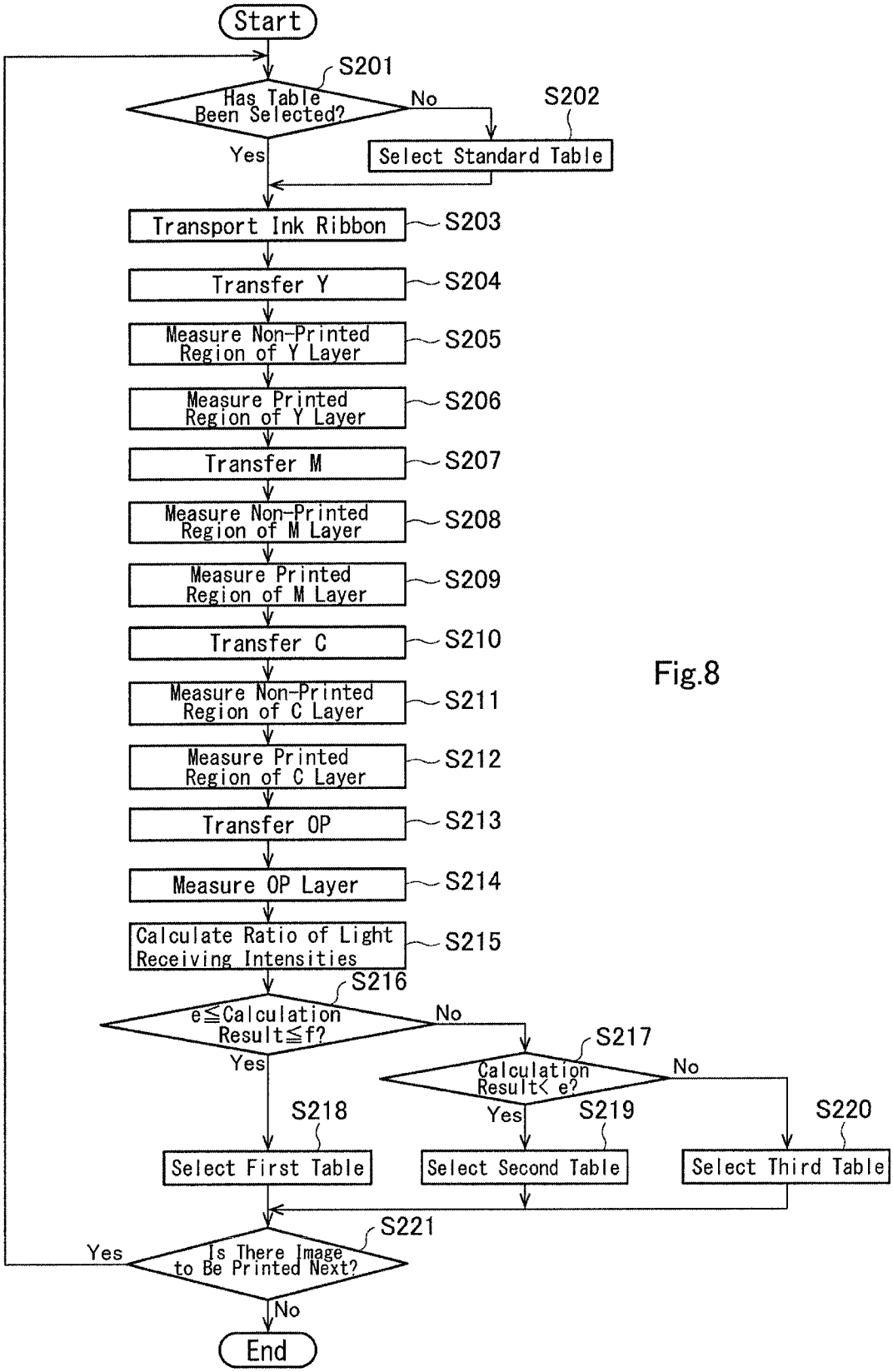
FIG. 8 is a flowchart for explaining a thermal transfer printing method according to a fourth embodiment.

A thermal transfer printing method according to the present embodiment is described by using the flowchart of FIG. 8. Steps S201 through S213 are identical to steps S101 through S113 in the flowchart of FIG. 7, and therefore description thereof is omitted.

After the OP layer 54 is transferred, the sensor 20 measures a light receiving intensity by irradiating a region (a protection layer formation region) of the ink ribbon 5 where the OP layer 54 was present with light (step S214).

The controller 10 calculates an amount x of light attenuation caused by the back-surface layer on the basis of a result of the measurement of the protection layer formation region. Then, the controller 10 calculates a ratio of a value obtained by subtracting the light attenuation amount x from the light receiving intensity measured in step S205 to a value obtained by subtracting the light attenuation amount x from the light receiving intensity measured in step S206 (step S215). This ratio corresponds to an ink transfer amount of Y. Similarly, the controller 10 calculates a ratio of a value obtained by subtracting the light attenuation amount x from the light receiving intensity measured in step S208 to a value obtained by subtracting the light attenuation amount x from the light receiving intensity measured in step S209. This ratio corresponds to an ink transfer amount of M. Furthermore, the controller 10 calculates a ratio of a value obtained by subtracting the light attenuation amount x from the light receiving intensity measured in step S211 to a value obtained by subtracting the light attenuation amount x from the light receiving intensity measured in step S212. This ratio corresponds to an ink transfer amount of C.

The controller 10 calculates an average of the ratios of the light receiving intensities of Y, M, and C. In a case where a result of the calculation is equal to or larger than a fifth predetermined value e and is equal to or smaller than a sixth predetermined value f (Yes in step S216), the controller 10 selects a first table from a storage unit 12 (step S218).

In a case where the result of the calculation is less than the fifth predetermined value e (No in step S216 and Yes in step S217), the controller 10 selects a second table from the storage unit 12 (step S219).

In a case where the result of the calculation is larger than the sixth predetermined value f (No in step S216 and No in step S217), the controller 10 selects a third table from the storage unit 12 (step S220).

In a case where there is an image to be printed next (Yes in step S221), printing processing is performed by controlling applied energy on the basis of the table selected in any one of steps S218 to S220.

As described above, even in a case where a table is selected on the basis of a light receiving intensity ratio indicative of an ink transfer amount of a previous ink layer 50 and applied energy during printing processing is controlled on the basis of the selected table, image quality of a printed image can be stabilized irrespective of an environment in which the ink ribbon 5 is stored and an environment in which the thermal transfer printing apparatus is placed.

Also in the present embodiment, tables of the respective colors may be individually selected on the basis of light receiving intensity ratios between printed regions and non-printed regions of the Y layer 51, the M layer 52, and the C layer 53, respectively. Furthermore, a light receiving intensity ratio of any one or two of the Y layer 51, the M layer 52, and the C layer 53 may be measured, and a table for an YMC set may be selected on the basis of a result of the measurement.

Although an example in which any one of three kinds of tables is selected on the basis of a result of measurement of a light receiving intensity has been described in the above embodiments, any one of four or more kinds of tables may be selected by increasing the number of boundary values. Furthermore, a formula for finding suitable applied energy from a result of measurement of a light receiving intensity may be prepared, and applied energy during printing processing may be calculated by substituting the result of the measurement into the formula.

In a case where a plurality of kinds of ink ribbons 5 can be set in the thermal transfer printing apparatus, boundary values (the first predetermined value a through the sixth predetermined value f) and tables may be stored in the storage unit 12 for each of the kinds of ink ribbons 5. Each ink ribbon 5 may be given a barcode or the like for identifying the kind, and the thermal transfer printing apparatus may identify the kind of set ink ribbon 5 by reading the barcode and use corresponding boundary values and tables.

Although a configuration in which the sensor 20 that detects ink content of the ink ribbon 5 has the light emitting unit 21 and the light receiving unit 22 that measures a light receiving intensity of transmission light has been described in the above embodiments, the configuration of the sensor 20 is not limited to this. For example, the sensor 20 may have an imaging unit such as a digital camera, image the Y layer 51, the M layer 52, and the C layer 53, and detect how much ink is contained from the images thus obtained.

The sensor 20 may be provided both between the ink ribbon feeding unit 3 and the thermal head 1 and between the thermal head 1 and the ink ribbon collecting unit 4.

The sensor 20 may also be used to count the number of printed frames and to find a start position of the ink ribbon 5.

In the first through third embodiments, an ink ribbon 5 in which the OP layer 54 is omitted may be used. In this case, a protection layer may be formed on an image by separately using a frame protection ribbon provided with the OP layer 54. For example, a protection layer forming unit including a supply roll that supplies a frame protection ribbon, a collecting roll that collects the frame protection ribbon, and a thermal head that thermally transfers a protection layer onto an image is provided on a downstream side of the printing unit 40 (or a downstream side relative to the cutter 8).

The present invention is not limited to the above embodiments and can be embodied by modifying constituent elements without departing from the spirit of the present invention. Various inventions can be formed by combining constituent elements disclosed in the above embodiments as appropriate. For example, one or more of the constituent elements described in the above embodiments may be deleted. Furthermore, constituent elements in different embodiments may be combined as appropriate.

The subject application is based on Japanese Patent Application No. 2017-129282 filed on Jun. 30, 2017, the entire contents of which are incorporated by reference.

REFERENCE SIGNS LIST

1 thermal head
2 platen roll
3 ink ribbon feeding unit
4 ink ribbon collecting unit
5 ink ribbon
7 printing sheet
10 controller
12 storage unit
20 sensor
40 printing unit
50 ink layer

The invention claimed is:

1. A thermal transfer printing apparatus that includes a thermal head and a platen roll and forms an image on printing paper by causing the thermal head to heat an ink ribbon including a plurality of consecutive ink layers, each of which includes sequential panels of a yellow layer, a magenta layer, and a cyan layer and thereby transfer ink while transporting, between the thermal head and the platen roll, the ink ribbon and the printing paper that are superimposed on each other, the thermal transfer printing apparatus comprising:

a sensor detecting ink content of the ink layers; and a controller controlling energy applied to the thermal head during image formation based on a result of the detection of the sensor, wherein the sensor is provided between the thermal head and an ink ribbon collecting unit collecting a used ink ribbon, and the sensor detects ink content in a printed region used for formation of an image on the printing paper and ink content in a non-printed region that is not used for image formation.

2. The thermal transfer printing apparatus according to claim 1, wherein the sensor includes a light emitting unit irradiating the ink ribbon with light and a light receiving unit receiving light that has passed through the ink ribbon.

3. The thermal transfer printing apparatus according to claim 1, wherein the ink ribbon includes sequential panels of a yellow layer, a magenta layer, a cyan layer, and a protection layer;

the thermal head transfers the protection layer onto an image formed on the printing paper; and the sensor includes a light emitting unit irradiating the ink ribbon with light and a light receiving unit receiving light that has passed through the ink ribbon, and measures an intensity of light that has passed through the printed region of the yellow layer, the magenta layer, or the cyan layer, an intensity of light that has passed through the non-printed region of the yellow layer, the magenta layer, or the cyan layer, and an intensity of light that has passed through a protection layer formation region.

4. A thermal transfer printing method comprising:

feeding out printing paper from a printing paper roll;

forming an image by causing a thermal head to transfer yellow, magenta, and cyan onto the printing paper by using an ink layer included in an ink ribbon including a plurality of consecutive ink layers, each of which includes sequential panels of a yellow layer, a magenta layer, and a cyan layer;

detecting ink content of the ink layer; and controlling energy applied to the thermal head during image formation based on the detected ink content, wherein the ink content of the ink layer is detected before image formation, and ink content in a printed region of the ink layer that is used for image formation on the printing paper and ink content in a non-printed region of the ink layer that is not used for image formation are detected after the image formation.

* * * * *